US009851168B2

(12) United States Patent
Hwang

(10) Patent No.: US 9,851,168 B2
(45) Date of Patent: Dec. 26, 2017

(54) CLEANING IMPLEMENTS FOR FIREARMS

(71) Applicant: Chien Hwang, Salt Lake City, UT (US)

(72) Inventor: Chien Hwang, Salt Lake City, UT (US)

( * ) Notice: Subject to any disclaimer, the term of this patent is extended or adjusted under 35 U.S.C. 154(b) by 0 days.

(21) Appl. No.: 15/152,454

(22) Filed: May 11, 2016

(65) Prior Publication Data

US 2016/0252318 A1 Sep. 1, 2016

Related U.S. Application Data

(63) Continuation of application No. 14/677,728, filed on Apr. 2, 2015, now Pat. No. 9,366,496.

(60) Provisional application No. 61/974,387, filed on Apr. 2, 2014.

(51) Int. Cl.
*F41A 29/02* (2006.01)

(52) U.S. Cl.
CPC ..... *F41A 29/02* (2013.01)

(58) Field of Classification Search
CPC ..... F41A 29/00; F41A 29/02; F41A 29/04
See application file for complete search history.

(56) References Cited

U.S. PATENT DOCUMENTS 393,810 A * 12/1888 Barker ..... A46B 3/18 15/104.19
690,393 A 1/1902 Bishop
966,100 A 8/1910 Johnson
4,680,824 A 7/1987 Lieptz
4,866,871 A * 9/1989 Rivers ..... F41A 29/02 15/104.16
4,962,607 A * 10/1990 Baldwin ..... F41A 29/02 15/104.165
6,699,331 B1 3/2004 Kritzler
7,356,961 B2 4/2008 Williams
(Continued)

FOREIGN PATENT DOCUMENTS

DE 3228986 * 2/1984 ..... F41C 31/00
WO WO2015153908 10/2015

OTHER PUBLICATIONS

Written Opinion for PCT/US2015/024143, dated Apr. 2, 2015, 5 pgs.

(Continued)

*Primary Examiner* — Stephen Johnson
(74) *Attorney, Agent, or Firm* — Phillips Ryther & Winchester; Jared L. Cherry

(57) ABSTRACT

The present disclosure pertains to systems and methods for cleaning implements for firearms. In one embodiment, a single-use cleaning implement may include a hollow member; and a cleaning surface disposed along a length of the hollow member. The cleaning surface may be disposed about a circumference of the hollow member. A flexible shaft may be configured to extend through the hollow member. The flexible shaft may comprise a retainer component disposed at a distal end, the retainer component configured to abut a distal end of the cleaning implement and to impede the cleaning implement from passing over the retainer component. The flexible shaft may be used to pull the hollow cleaning implement through the barrel of the firearm while the retainer component abuts the distal end of the cleaning implement and the first cleaning surface engages with an inner surface of the barrel to clean the barrel.

15 Claims, 12 Drawing Sheets

(56) References Cited

U.S. PATENT DOCUMENTS

| | | | | |
|---|---|---|---|---|
| 7,367,151 | B1 | 5/2008 | Black et al. | |
| 7,441,363 | B1 | 10/2008 | Black et al. | |
| 8,302,342 | B2 | 11/2012 | Krieger | |
| 8,429,846 | B2 | 4/2013 | Krieger | |
| 8,793,918 | B2 | 8/2014 | Rogers et al. | |
| 2006/0147247 | A1 | 7/2006 | Whipple | |
| 2007/0266610 | A1 | 11/2007 | Coffield | |
| 2011/0016649 | A1 | 1/2011 | Reggio et al. | |
| 2011/0083354 | A1* | 4/2011 | Krieger | F41A 29/02 42/95 |
| 2011/0209379 | A1 | 9/2011 | Williams | |
| 2012/0124883 | A1* | 5/2012 | Reggio | F41A 29/02 42/95 |
| 2012/0198747 | A1 | 8/2012 | Niebling | |
| 2013/0091753 | A1 | 4/2013 | Rogers et al. | |
| 2013/0125925 | A1* | 5/2013 | Markle | F41A 29/02 134/8 |
| 2013/0269234 | A1 | 10/2013 | Williams et al. | |

OTHER PUBLICATIONS

International Search Report for PCT/US2015/024143, dated Apr. 2, 2014, 2 pgs.

* cited by examiner

CLEANING IMPLEMENTS FOR FIREARMS

RELATED APPLICATIONS

The present application claims the benefit under 35 U.S.C. §119(e) of U.S. Provisional Patent Application No. 61/974,387, filed Apr. 2, 2014, and titled "CLEANING IMPLEMENTS FOR FIREARMS," which is incorporated herein by reference in its entirety. The present application also claims the benefit under 35 U.S.C. §120 of U.S. patent application Ser. No. 14/677,728, now issued as U.S. Pat. No. 9,366,496, filed Apr. 2, 2015, and titled "CLEANING IMPLEMENTS FOR FIREARMS," which is incorporated herein by reference in its entirety.

TECHNICAL FIELD

This disclosure relates to systems and methods for cleaning a barrel of a firearm. More specifically, the present disclosure may include embodiments in which a cleaning implement may be used in connection with standard firearm cleaning equipment.

BRIEF DESCRIPTION OF THE DRAWINGS

Non-limiting and non-exhaustive embodiments of the disclosure are described, including various embodiments of the disclosure, with reference to the figures, in which.

DETAILED DESCRIPTION

The embodiments of the disclosure will be best understood by reference to the drawings, wherein like parts are designated by like numerals throughout. It will be readily understood that the components of the disclosed embodiments, as generally described and illustrated in the figures herein, could be arranged and designed in a wide variety of different configurations. Thus, the following detailed description of embodiments of the systems and methods of the disclosure is not intended to limit the scope of the disclosure, as claimed, but is merely representative of possible embodiments of the disclosure. In addition, the steps of a method do not necessarily need to be executed in any specific order, or even sequentially, nor need the steps be executed only once, unless otherwise specified.

In some cases, well-known features, structures or operations are not shown or described in detail. Furthermore, the described features, structures, or operations may be combined in any suitable manner in one or more embodiments. It will also be readily understood that the components of certain embodiments, as generally described and illustrated in the figures herein, could be arranged and designed in a wide variety of different configurations.

Figure 1:
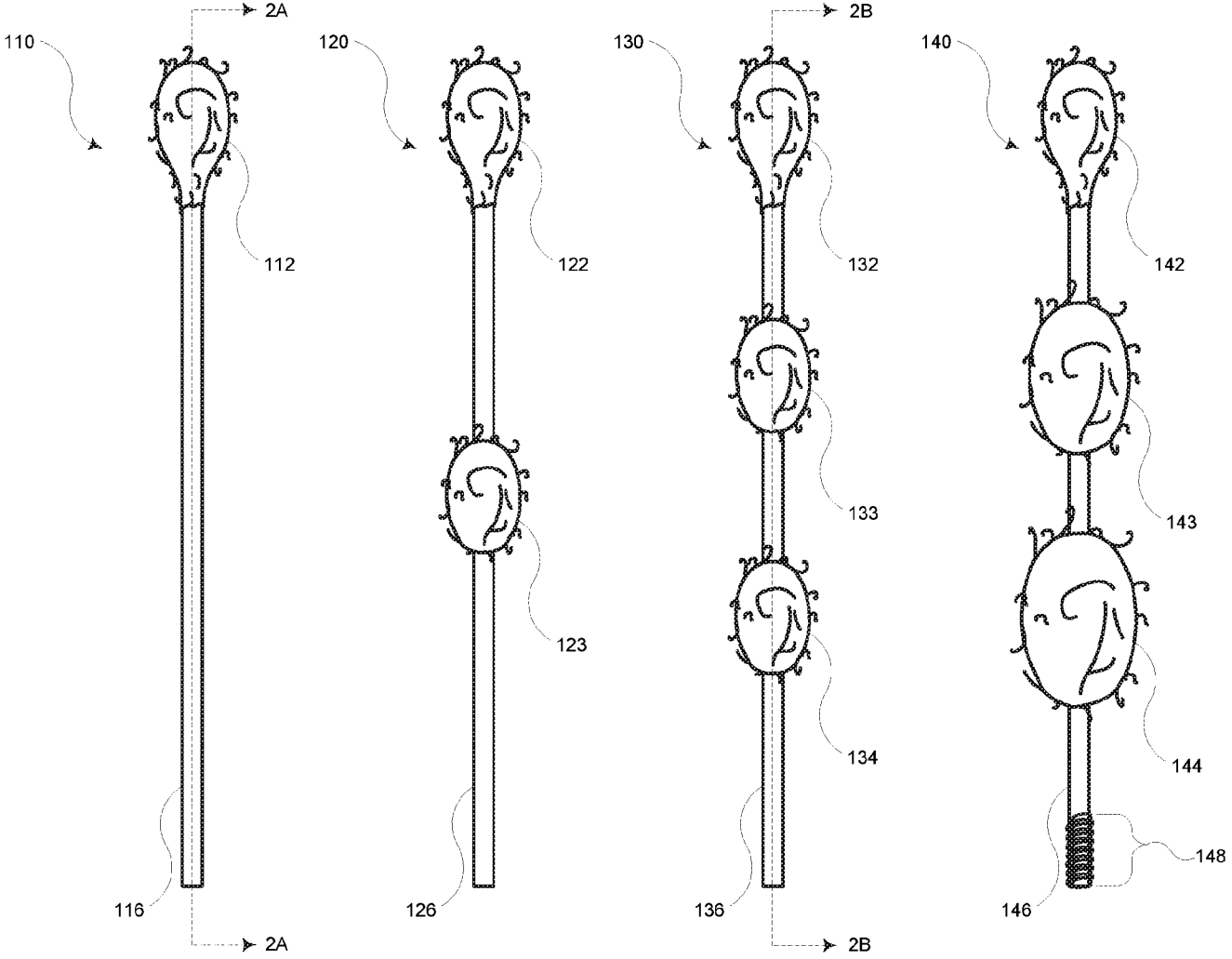
FIG. 1 illustrates a plurality of disposable cleaning implements having one or more cleaning surfaces consistent with embodiments of the present disclosure.

FIG. 1 illustrates a plurality of cleaning implements 110, 120, 130, and 140 having one or more cleaning surfaces consistent with embodiments of the present disclosure. Cleaning implement 110 includes a single cleaning surface 112 disposed at a distal end of a shaft 116. In some embodiments, the cleaning surface 112 may comprise cotton, wool, felt, flannel, synthetic fibers, and the like. In other embodiments, a more abrasive material may be used to form the cleaning surface 112, such as steel wool, brass wool, pumice mixed with cotton threads, ceramic abrasives mixed with cotton threads, other metals/metallic alloys, and the like. A more coarse or abrasive substance may be used when dictated by the condition of the barrel (i.e., amount of fouling in the barrel).

The cleaning surface 112 may be sized such that it is compressed when inserted into the barrel of a firearm. The compression of the cleaning surface 112 may exert an outward pressure on the barrel of the firearm and increase the ability of the cleaning surface 112 to clean the barrel and maintain the center of shaft 116 in the barrel and in/on the tip of a cleaning rod. Further, when the cleaning surface 112 exits from a distal end of a barrel, the cleaning surface 112 may expand and impede re-entry of the cleaning implement 110 into the barrel of the firearm.

The cleaning implement 120 includes two cleaning surfaces 122 and 123 disposed along a shaft 126. In some embodiments, the shaft may comprise wood, plastic, metal, or any suitable material. The material may be selected, in certain embodiments, to allow for low-cost production of disposable or one-time-use cleaning implement 120. The shaft 126 may be sized to fit within cleaning equipment produced by a variety of vendors and that are sold in a variety of outlets. The shaft 126 may be sized to fit in/on existing cleaning rods, which may be sold individually or as kits comprising various cleaning equipment that may be used for cleaning a firearm.

A plurality of cleaning surfaces disposed along the length of a shaft of a cleaning implement may serve to center the cleaning implement in the barrel of a firearm and center the cleaning implement shaft in/on the tip of the cleaning rod as the cleaning implement is passing through the barrel during cleaning. As illustrated in FIG. 1, cleaning implements 120, 130, and 140 each include a plurality of cleaning surfaces disposed along the length of their respective shafts. As illustrated, cleaning implement 120 includes cleaning surfaces 122 and 123; cleaning implement 130 includes cleaning surfaces 132, 133, and 134; and cleaning implement 140 includes cleaning surfaces 142, 143, and 144. Each of the plurality of cleaning surfaces may be in contact with the barrel when the cleaning implements 120, 130, and 140 are inserted into the barrel and pushed or pulled along the length of the barrel. As may be appreciated, contact between the plurality of cleaning implements and the barrel may keep the shaft of the cleaning implement approximately centered within the barrel and on/in the tip of a cleaning rod.

Cleaning implement 130 includes three cleaning surfaces 132, 133, and 134. In various embodiments, each of the three cleaning surfaces may be formed of different materials. For example, in one embodiment, cleaning surface 132 may be formed of brass wool or brass bristles, cleaning surface 133 may be formed of a synthetic fiber, and cleaning surface 134 may be formed of brass wool. Still further, in some embodiments, different solvents and/or lubricants may be applied to cleaning surfaces 132, 133, and 134. The different materials and/or different solvents or lubricants may allow each of cleaning surfaces 132, 133, and 134 to achieve the result of three separate passes in a single pass, thus potentially reducing the time needed to clean a firearm.

Cleaning implement 140 includes a plurality of cleaning surfaces 142, 143, and 144 of increasing size. The sequentially increasing sizes of cleaning surfaces 142, 143, and 144 may apply a corresponding level of outward pressure on the barrel of the firearm, and may therefore be more effective in cleaning the barrel. As noted in connection with cleaning implement 130, different solvents and/or lubricants may be applied to each of cleaning surfaces 142, 143, and 144. Cleaning implement 140 also includes a threaded portion 148 disposed at the proximal end of shaft 146. The threaded portion 148 may be used in certain embodiments to couple cleaning implement 140 to a rod that may be used to push cleaning implement 140 along the barrel of a firearm.

Figure 2A:
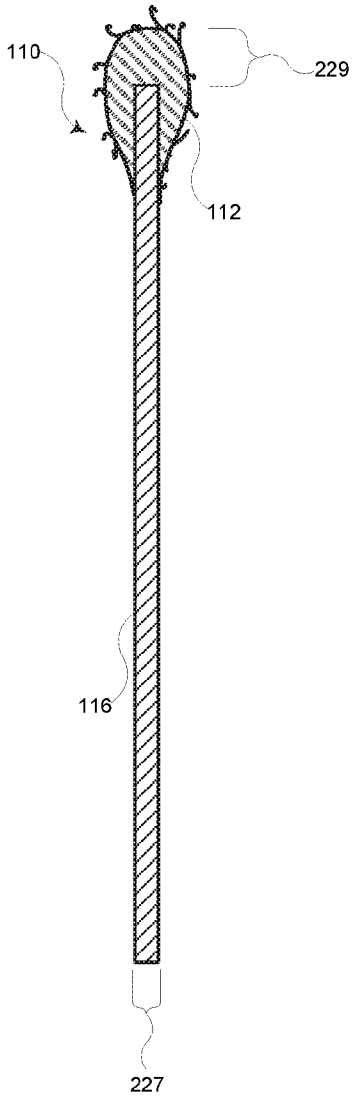
FIG. 2A illustrates a cross-sectional view taken along line 2A-2A of one of the cleaning implements illustrated in FIG. 1.

FIG. 2A illustrates a cross-sectional view taken along line 2A-2A of the cleaning implement 110 illustrated in FIG. 1. As shown in FIG. 2A, cleaning surface 112 may be disposed at a distal end of the shaft 116, and may extend beyond the distal end of the shaft 116 by a distance 229. In other embodiments, the cleaning surface 112 may be coterminous with the shaft. The shaft 116 of the cleaning implement 110 may be uniform along its length. The simplicity of cleaning implement 110 may contribute to a low cost of production, which may in turn permit use of cleaning implement 110 as a disposable or single-use product. Although cleaning implements 110, 120, and 130 include additional cleaning surfaces and other features, these cleaning implements may also have a sufficiently low cost of production that the cleaning implements may be used as disposable products.

In some embodiments, a diameter 227 of the shaft 116 may be smaller than the female end of a commonly available cleaning rod configured to receive the shaft 116 and to push the cleaning implement 110 along the length of a barrel of a firearm. In some embodiments, a rod (not shown) of firearm cleaning device may include a threaded female receptacle (not shown) that is configured to receive a male threaded tip (not shown). The cleaning implement 110 may be used in place of the threaded tip. The diameter 227 may be selected such that the proximal end of the cleaning implement 110 fits within and is received by the female receptacle disposed at the end of the rod. In some embodiments, the fit may be a friction fit, such that some amount of force is needed to overcome friction between the shaft 116 and the threads to engage or disengage the cleaning implement 110 from the receptacle.

In some embodiments, the rod may only be effective for pushing the cleaning implement 110 through the barrel since the cleaning implement 110 lacks threads on the proximal end of the cleaning implement 110. In other words, while a rod configured to receive a threaded tip may be used to push the cleaning implement 110 from a proximal end to a distal end of a barrel, motion of the rod in the opposite direction (i.e., from a distal end to a proximal end of a barrel) may result in separation of the rod and the cleaning element 110.

Figure 2B:
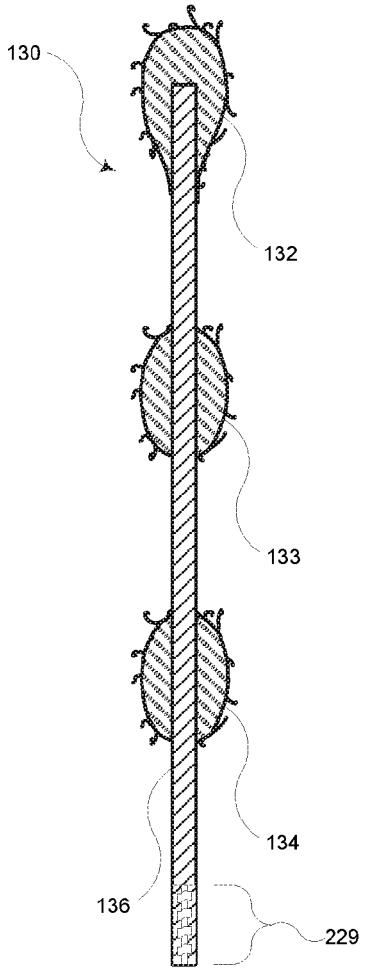
FIG. 2B illustrates a cross-sectional view taken along line 2B-2B of one of the cleaning implements illustrated in FIG. 1.

FIG. 2B illustrates a cross-sectional view taken along line 2B-2B of the disposable cleaning implement 130 illustrated in FIG. 1. As illustrated, cleaning surfaces 132, 133, and 134 may be disposed along and wrapped around shaft 136. A threaded portion 229 may be disposed at a proximal end of shaft 136. The threaded portion 229 may be used in certain embodiments to couple cleaning implement 130 to a threaded rod that may be used to push or pull cleaning implement 130 along the barrel of a firearm. In contrast to cleaning implement 110, which lacks a threaded portion, cleaning implement 130 may be moved backward and forward within a barrel of a firearm because it may be secured to a rod (not shown) by threaded portion 229.

Figure 3:
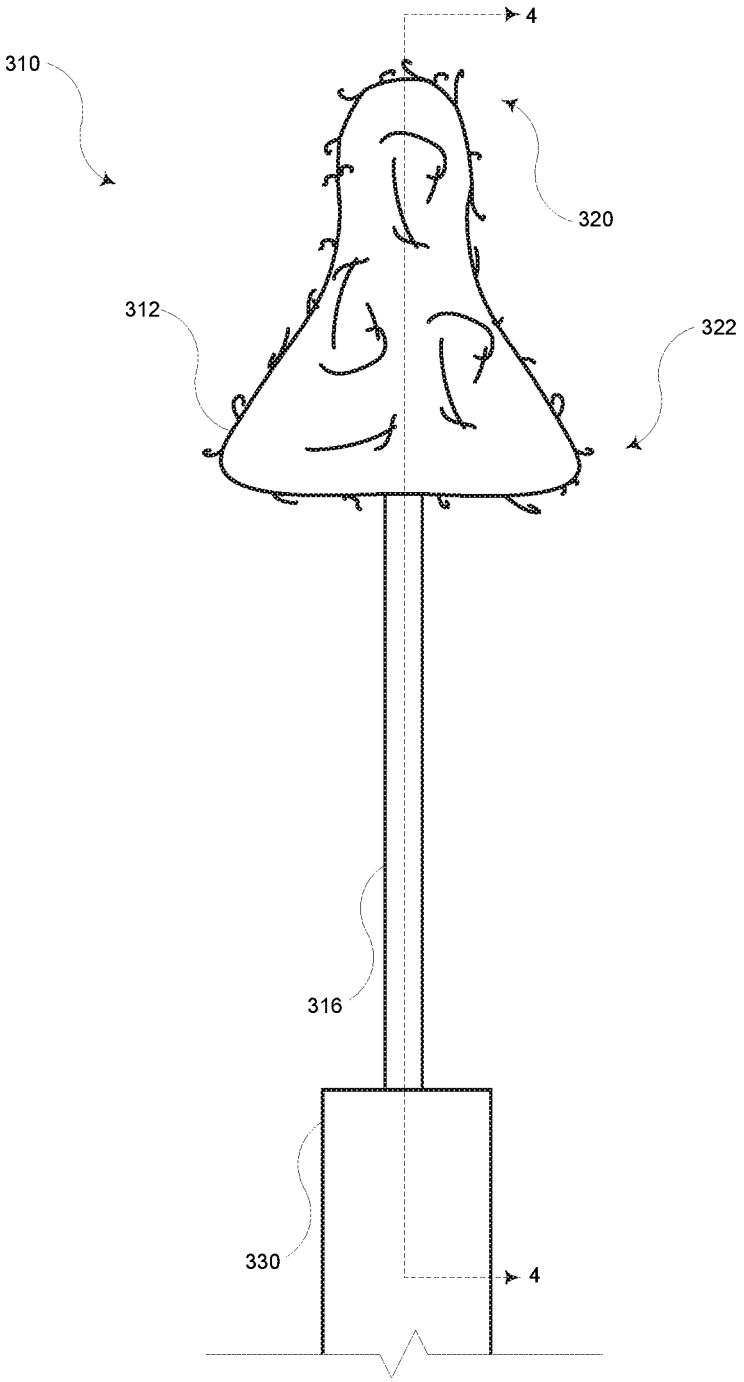
FIG. 3 illustrates a disposable cleaning implement with a cleaning surface that increases in width from a distal end to a proximal end that is received within a cleaning rod consistent with embodiments of the present disclosure.

FIG. 3 illustrates a cleaning implement 310 with a cleaning surface 312 that increases in width from a distal end 320 to a proximal end 322 that is received within a cleaning rod 330 consistent with embodiments of the present disclosure. Cleaning implement 310 includes a shaped cleaning surface 312 disposed at a distal end of a shaft 316. In the illustrated embodiment, the cleaning surface 312 has a bell shape. In other embodiments, the cleaning surface may have other shapes that increase in width from the distal end 320 to the proximal end 322, including a conical shape, a pyramidal shape, etc. In some embodiments, the cleaning surface 312 may comprise cotton, wool, flannel, synthetic fibers, and the like. In other embodiments, a more abrasive material may be used to form the cleaning surface 312, such as brass wool or steel wool. At least a portion of the cleaning surface 312 may be compressed when inserted into the barrel of a firearm. The compression of the cleaning surface 312 may exert an outward pressure on the barrel of the firearm and increase the ability of the cleaning surface 312 to clean the barrel. The outward pressure may be greatest toward the proximal end 322 of the cleaning surface, where the width of the cleaning surface 312 is the greatest.

The shaft 316 may be received in a receptacle at the end of a rod 330. A diameter of the shaft 316 may be smaller than the end of the cleaning rod 330, which according to various embodiments may be a commercially available product or a custom model, configured to receive the shaft 316 and to push the cleaning implement 310 along the length of a barrel of a firearm. When the cleaning surface 312 is pushed out of the end of a distal end of a barrel of a firearm, the cleaning surface proximal end 322 may expand and impede re-entry of the cleaning implement 310 into the barrel of the firearm as the rod 330 is withdrawn from the barrel.

Figure 4:
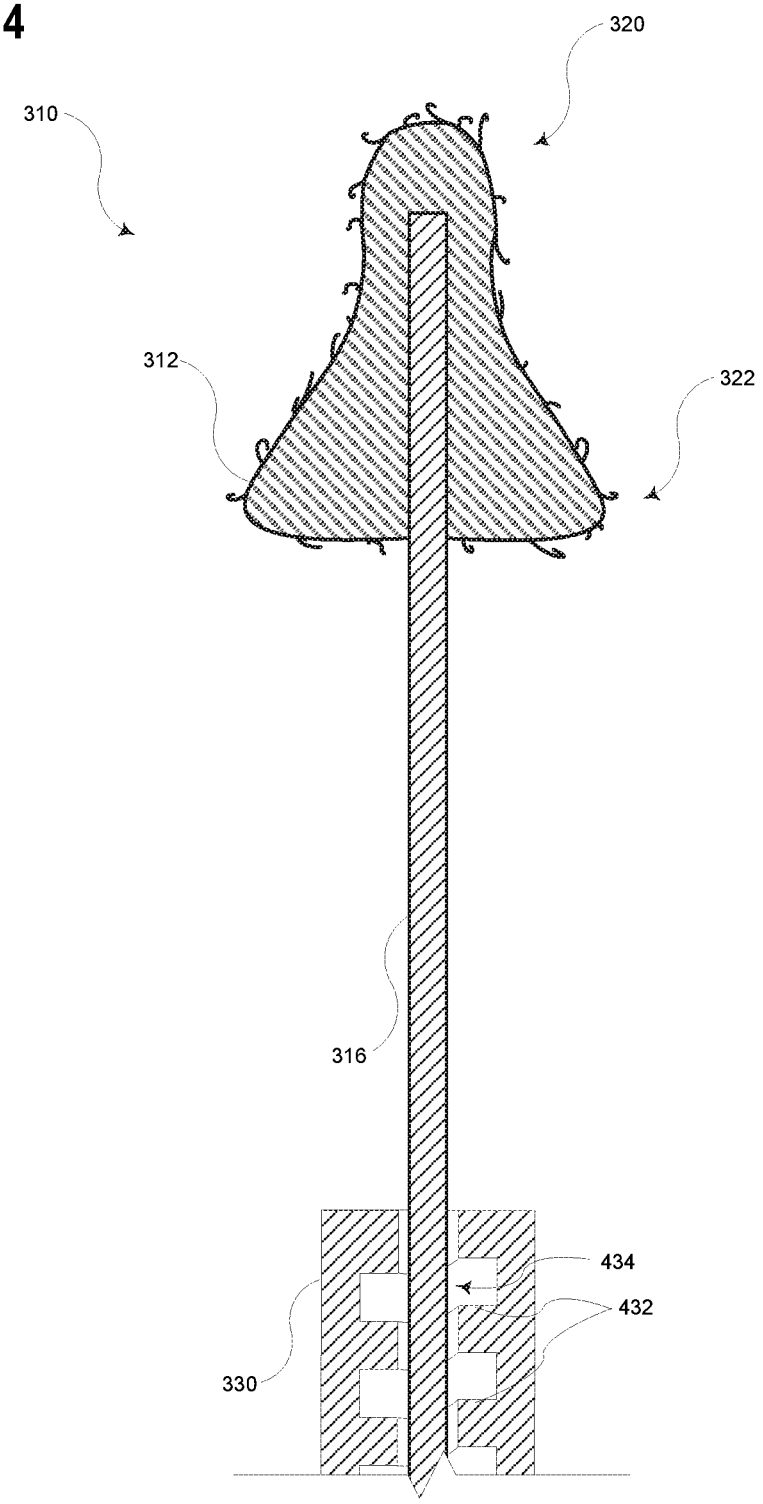
FIG. 4 illustrates a cross-sectional view taken along line 4-4 of the cleaning implement and cleaning rod illustrated in FIG. 3.

FIG. 4 illustrates a cross-sectional view taken along line 4-4 of the cleaning implement 310 and cleaning rod 330 illustrated in FIG. 3. A diameter of the shaft 316 may be smaller than the end of the cleaning rod 330 configured to receive the shaft 316 and to push the cleaning implement 310 along the length of a barrel (not shown) of a firearm. In the illustrated embodiment, a rod 330 of a firearm cleaning device includes a plurality of threads 432 disposed within a female receptacle 434. The shaft 316 of the cleaning implement 310 may be received within female receptacle 434. The diameter of the shaft 316 may be selected such that the proximal end of the shaft 316 fits within and is received by the female receptacle 434 disposed at the end of the rod 330. Accordingly, the rod 330 may be effective only to push the cleaning implement 310 through the barrel (not shown) since the cleaning implement 310 lacks threads on the proximal end. In other words, while the rod 330 may be configured to receive the shaft 316 and to push the cleaning implement 310 from a proximal end to a distal end of a barrel (not shown), motion of the rod 330 in the opposite direction (i.e., from a distal end to a proximal end of the barrel) may result in separation of the rod 330 and the shaft 316 of the cleaning element 310.

Figure 5A:
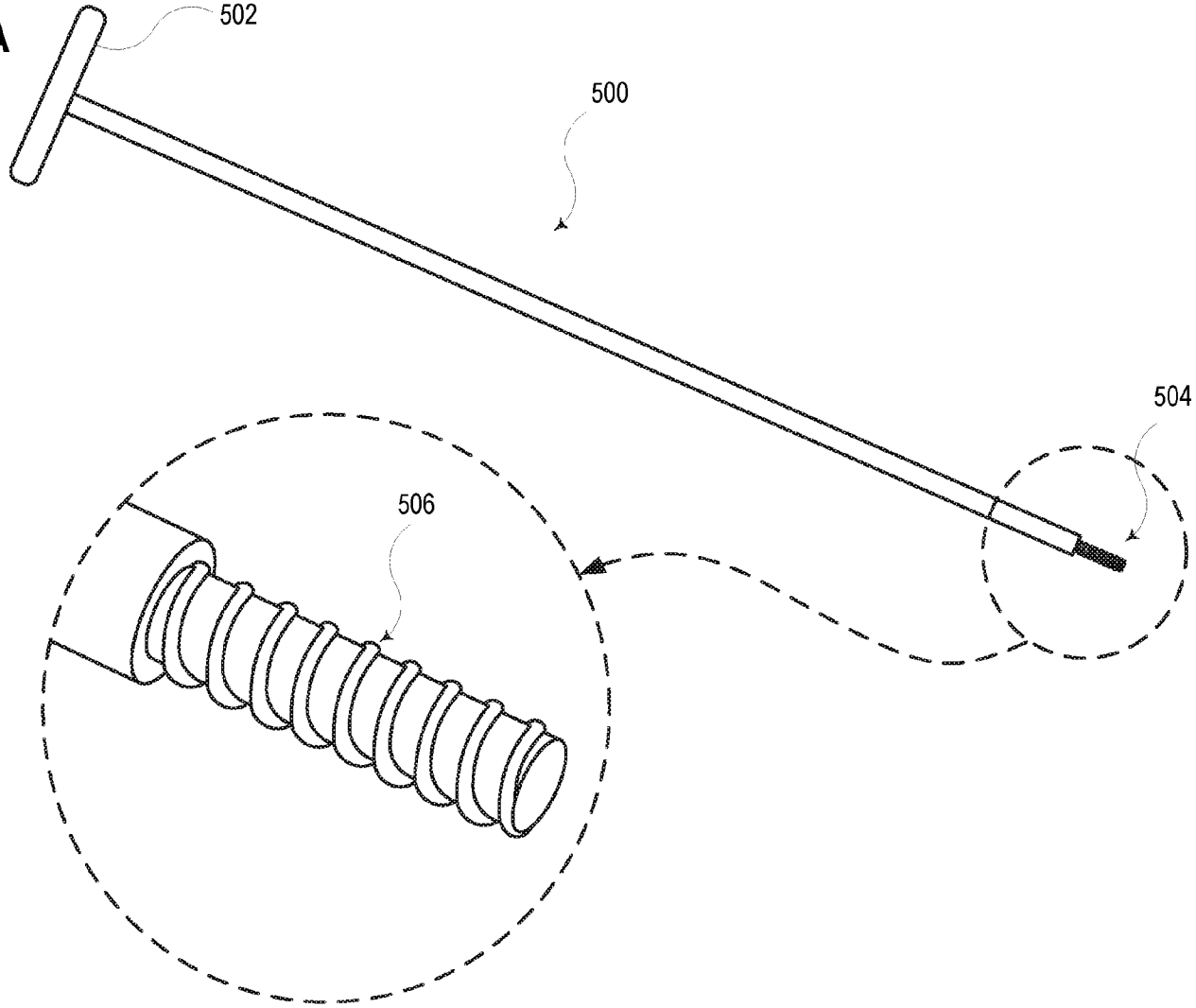
FIG. 5A illustrates a perspective view of a cleaning rod having a threaded male connector disposed at a distal end that may be used in connection with various embodiments of the present disclosure.

FIG. 5A illustrates a perspective view of a cleaning rod 500 having a threaded male connector 506 disposed at a distal end 504 that may be used in connection with various embodiments of the present disclosure. A handle 502 may be disposed at a proximate end and may permit a user to manipulate the cleaning rod 500. In various embodiments, the cleaning rod 500 may allow a user to move a cleaning implement (not shown) through the barrel of a firearm. As described previously, various cleaning implements consistent with the present disclosure may include a threaded receptacle that is configured to couple to the distal end 504 of cleaning rod 500. More specifically, as illustrated in FIG. 2B, cleaning implement 130 may be configured to couple to cleaning rod 500 and may be used to clean the barrel of a firearm. As one of skill in the art will appreciate, appropriate modification may be made to any of the other cleaning implements disclosed in the present application that would permit such cleaning implements to couple to cleaning rod 500. For example, a female, non-threaded opening in the end of shaft may be configured to receive a threaded male end of a cleaning rod.

Figures 5B, 5C:
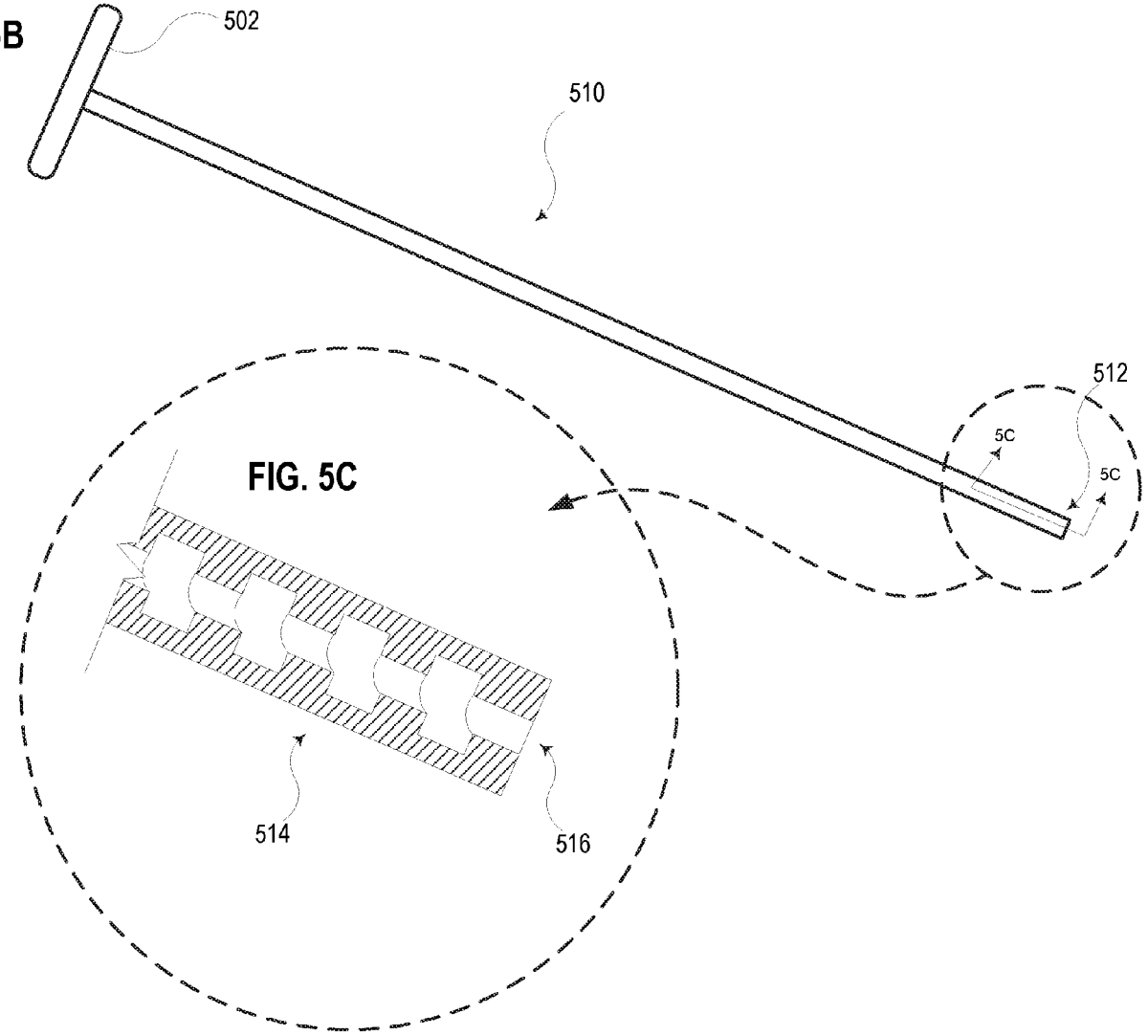
FIG. 5B illustrates a perspective view of a cleaning rod having a threaded female connector disposed at a distal end that may be used in connection with various embodiments of the present disclosure.
FIG. 5C illustrates an enlarged cross-sectional view of a threaded female connector taken along the line 5C-5C in FIG. 5B that may be used in connection with various embodiments of the present disclosure.

FIG. 5B illustrates a perspective view of a cleaning rod 510 having a threaded female connector disposed at a distal end 512 that may be used in connection with various embodiments of the present disclosure. A handle 502 may be disposed at a proximate end and may permit a user to manipulate the cleaning rod 510.

FIG. 5C illustrates an enlarged cross-sectional view of a threaded female connector 514 taken along the line 5C-5C in FIG. 5B. The threaded female connector 514 may include an aperture 516 that may be configured to allow a user to move a cleaning implement (not shown) through the barrel of a firearm. As described previously, various cleaning implements consistent with the present disclosure may include a threaded male connector that is configured to couple to the distal end 512 of cleaning rod 510. More specifically, as illustrated in FIG. 1, cleaning implement 140 includes a threaded male connector that may couple to cleaning rod 510 and may be used to clean the barrel of a firearm. As one of skill in the art will appreciate, appropriate modification may be made to any of the other cleaning implements disclosed in the present application that would permit such cleaning implements to couple to cleaning rod 510. For example, an unthreaded shaft may be configured to couple with the threaded end 514 by way of a friction fit.

In still other embodiments, cleaning implements lacking a threaded component may be used in connection with cleaning rod 510. More specifically, as described in connection with FIG. 4 a shaft of a cleaning implement may be inserted into a threaded female connector 514. Returning to a discussion of FIG. 5B, the diameter of a shaft of a cleaning implement (not shown) may be selected such that the shaft is received by the female receptacle 516 disposed at the distal end 512 of the cleaning rod 510. Accordingly, the cleaning rod 510 may be effective only to push the cleaning implement through the barrel (not shown) since the cleaning implement lacks threads to couple to the threaded female connector 514. In other words, while the cleaning rod 510 may be configured to receive a shaft of a cleaning implement and to push the cleaning implement from a proximal end to a distal end of a barrel (not shown), motion of the rod 510 in the opposite direction (i.e., from a distal end to a proximal end of the barrel) may result in separation of the rod 510 and the shaft of the cleaning element.

Figure 6:
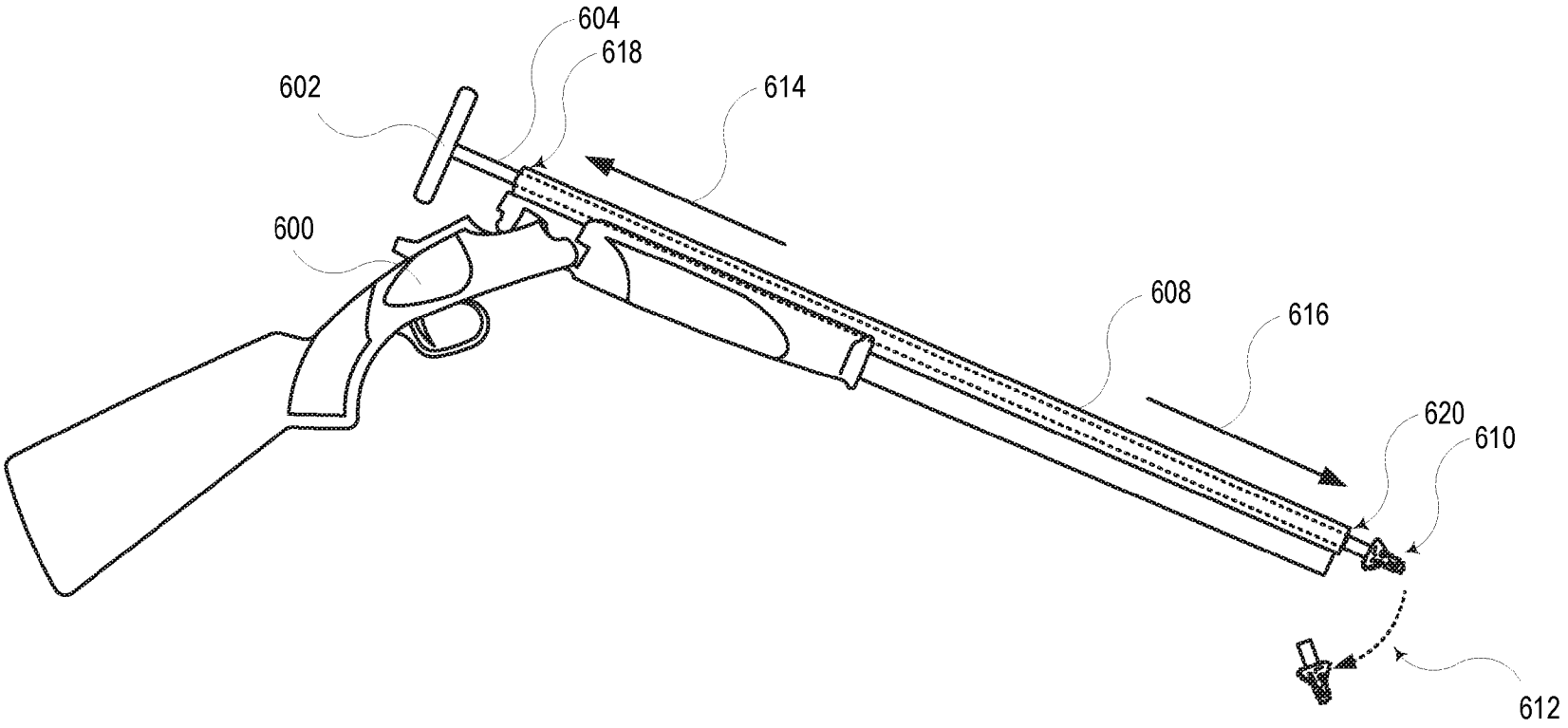
FIG. 6 illustrates a perspective view of standard firearm cleaning equipment coupled to a disposable cleaning implement consistent with embodiments of the present disclosure.

FIG. 6 illustrates a perspective view of a cleaning rod 604 in engagement with a cleaning implement 610 and inserted into a barrel 608 of a firearm 600 consistent with embodiments of the present disclosure. The cleaning rod 604 includes a handle 602 that a user may grasp to manipulate the cleaning rod 604 and to cause the cleaning implement 610 to move along the length of the barrel 608 in the direction shown by arrow 616. As previously described, the cleaning implement 610 may be received within a female receptacle disposed at a distal end of the cleaning rod 604. Accordingly, when the cleaning rod 604 is moved in the direction shown by arrow 614, the cleaning rod 604 may disengage from the cleaning implement 610.

The cleaning implement 610 may exert an outward pressure against the barrel 608 while the cleaning implement 610 is disposed within the barrel 608 because the diameter of the cleaning implement 610 may exceed the diameter of the barrel 608. The outward pressure exerted by the cleaning implement 610 may be caused by compression of the cleaning implement 610 within the barrel 608. The pressure exerted by the cleaning implement 610 may help to clean the barrel 608 as the cleaning implement 610 passes from a proximal end 618 of the barrel 608 to a distal end 620 of the barrel 608. When the cleaning implement 610 exits from the distal end 620 of the barrel 608 the greater diameter of the cleaning implement 610 in comparison to the barrel 608 may prevent re-entry of the cleaning implement 610 into the barrel 608. As the cleaning rod 604 is moved in the direction of arrow 614, the cleaning implement 610 may disengage from the cleaning rod 604 as shown by arrow 612.

Figure 7:
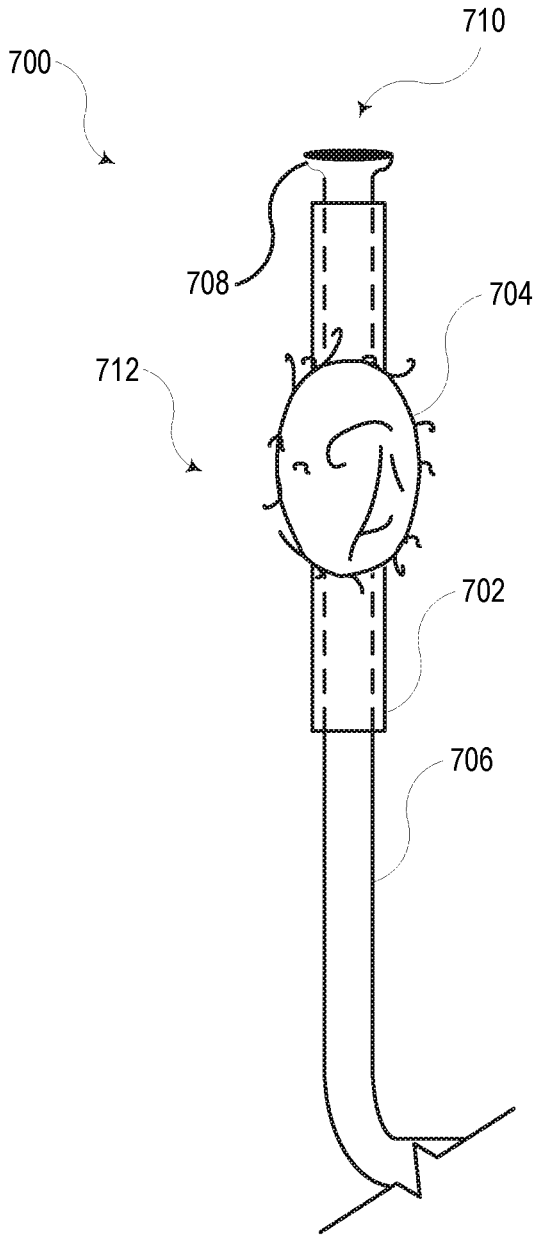
FIG. 7 illustrates a perspective view of a system for cleaning a firearm using a cleaning surface disposed on a hollow member that may be pulled through a barrel of the firearm using a flexible shaft consistent with embodiments of the present disclosure.

FIG. 7 illustrates a perspective view of a system 700 for cleaning a firearm using a cleaning surface disposed on a hollow member 702 that may be pulled through a barrel of the firearm using a flexible shaft 706 consistent with embodiments of the present disclosure. System 700 includes a cleaning implement 712 with a cleaning surface 704 disposed about a hollow member 702 with a flexible shaft 706 slideably inserted through the member 702. In contrast to the embodiment illustrated in FIG. 6, in which the cleaning implement is pushed through the barrel of a firearm during a cleaning process, system 700 may permit the hollow cleaning implement 702 to be pulled through the barrel. The cleaning surface 704 may clean a barrel and remove soot or other debris from the barrel as it is pulled through the barrel. In various embodiments, the cleaning surface may increases in width from a distal end to a proximal end or be formed in other configurations.

In various embodiments, the flexible shaft 706 may be formed of a variety of materials. For example, the flexible shaft 706 may be embodied as a plastic cord, a string, a rope, etc. In one specific embodiment, the flexible shaft 706 may comprise a plastic cord that may also be used in a line trimmer or string trimmer that may be used to trim grass and other plants. In other embodiments, the flexible shaft 706 may be embodied as a nylon string or rope.

A distal end 710 of the flexible shaft 706 may be configured to retain the hollow cleaning implement 702 on the flexible shaft 706 as the hollow cleaning implement 702 is pulled through a barrel of a firearm. In the illustrated embodiment, the flexible shaft 706 includes a flared portion 708. In one particular embodiment in which the flexible shaft is embodied as a plastic line, the flared portion 708 may be formed by heating the distal end 710 until the distal end at least partially melts and deforms. The deformation caused by heating may result in the flared portion 708, illustrated in FIG. 7. As the hollow cleaning implement 702 is pulled through the barrel of the firearm, the flared portion 708 may abut a distal end of the hollow cleaning implement 702 and may impede the hollow cleaning implement 702 from decoupling from the flexible shaft 706 by passing over the flared portion 708.

Figure 8:
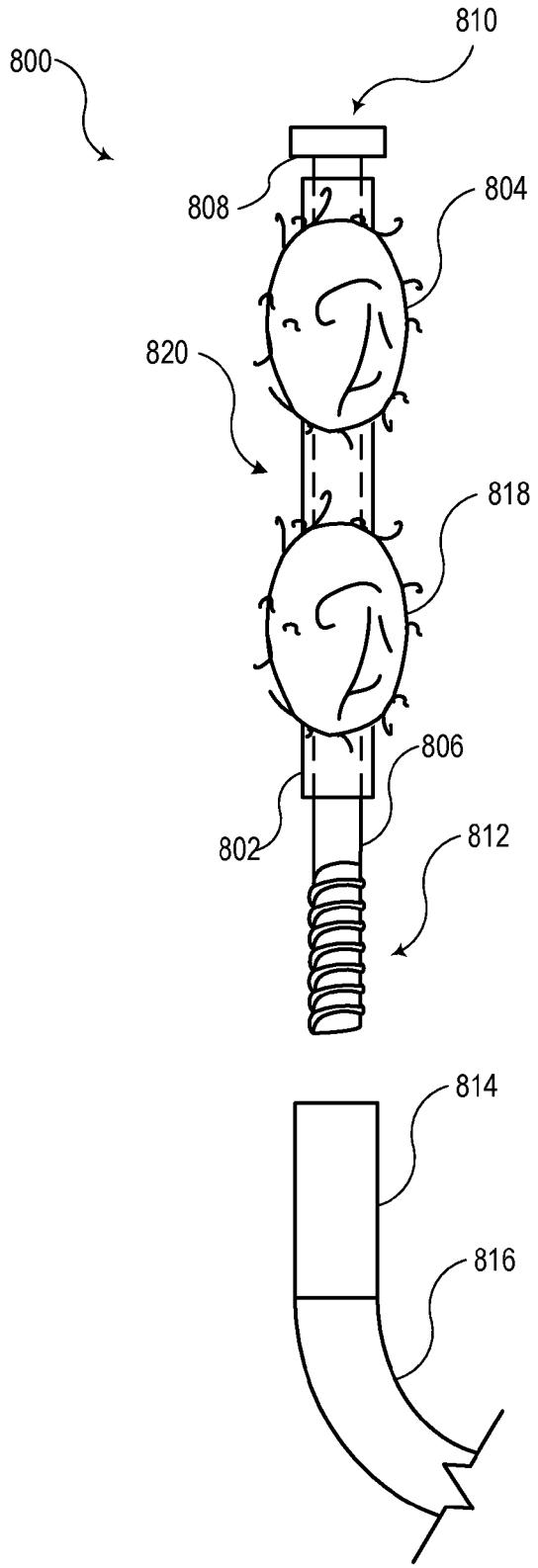
FIG. 8 illustrates a perspective view of a system for cleaning a firearm using a flexible shaft including a coupler configured to be received by a hollow cleaning implement consistent with embodiments of the present disclosure.

FIG. 8 illustrates a perspective view of a system 800 for cleaning a firearm using a flexible shaft including a coupler 806 configured to be received by a hollow cleaning implement 802 consistent with embodiments of the present disclosure. System 800 includes a hollow cleaning implement 802 with a first cleaning surface 804 disposed about the hollow cleaning implement 802. A second cleaning surface 818 may also be disposed about the hollow cleaning implement 802. The first cleaning surface 804 and the second cleaning surface 818 may be separated by a separator 820. The first cleaning surface 804 and the second cleaning surface 818 may clean a barrel and remove soot or other debris from the barrel as it is pulled through a barrel of a firearm (not shown). In various embodiments, more or fewer cleaning surfaces may be disposed along the length of the hollow cleaning implement 802 than are shown in FIG. 8.

The coupler 806 may be inserted into the hollow cleaning implement 802. The coupler 806 may include a male threaded portion 812 that may be received within a female threaded component 814 disposed on the end of a flexible shaft 816. The flexible shaft 816 may be formed of a variety of materials. For example, the flexible shaft 816 may be embodied as a plastic cord, a string, a rope, etc. In one embodiment, the female threaded component may be affixed to the flexible shaft 816 by a user. The coupler 806 may further include a retainer 808 disposed at the distal end 810 of the coupler 806. The retainer 808 may be configured to retain the hollow cleaning implement 802 on the coupler 806 as the hollow cleaning implement 802 is pulled through a barrel of a firearm by impeding the hollow cleaning implement 802 from passing over the retainer 808 as the flexible shaft 816, the coupler 806, and the hollow cleaning implement 802 are pulled through the barrel of a firearm. In various embodiments, the hollow cleaning implement 802 may be disposable, while the flexible shaft 816 and the coupler 806 may be reusable.

Figure 9:
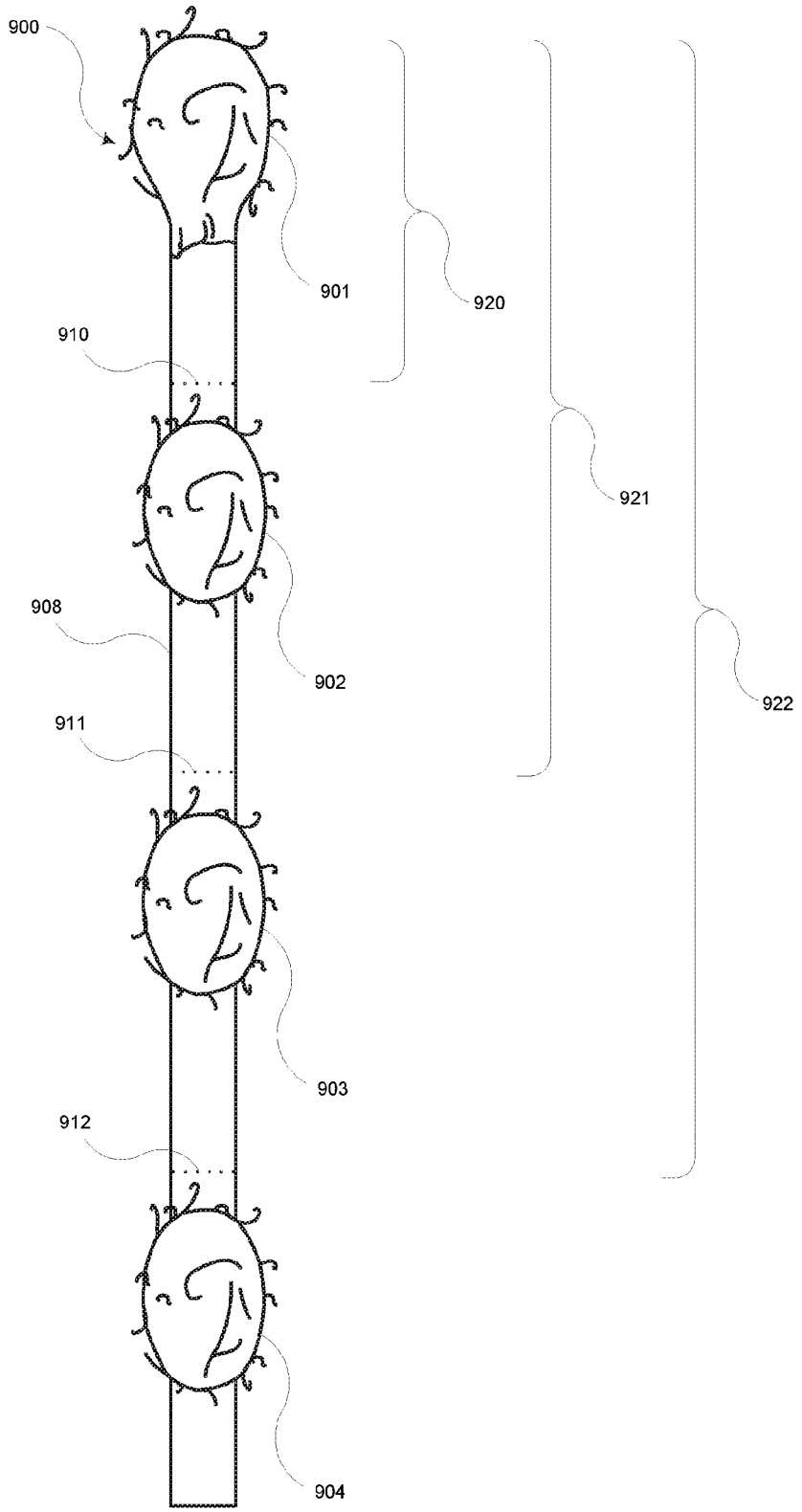
FIG. 9 illustrates a cleaning implement having a plurality of cleaning surfaces that may be separated by a user into a plurality of separate cleaning implements having a desired number of cleaning surfaces consistent with embodiments of the present disclosure.

FIG. 9 illustrates a cleaning implement 900 having a plurality of cleaning surfaces 901, 902, 903, and 904 that may be separated by a user into a plurality of separate cleaning implements having a desired number of cleaning surfaces consistent with embodiments of the present disclosure. As described in connection with other embodiments, the cleaning surfaces 901, 902, 903 and 904 may be sized such that they are compressed when inserted into the barrel of a firearm (not shown) and may be formed of a variety materials.

Separators 910, 911, and 912 may be disposed along a shaft 908 and disposed between each of the plurality of cleaning surfaces 901, 902, 903, and 904. In the illustrated embodiment, a user may separate cleaning implement 900 into a single-cleaning-surface implement 920, a double-cleaning-surface implement 921, or a triple-cleaning-surface implement 922. Users may desire to separate cleaning implement 900 into separate cleaning implements for a variety of reasons. Specifically, a user may desire to accomplish multiple cleaning passes through a barrel of a firearm using different cleaning solvents, or a user may desire to utilize more or fewer cleaning surfaces depending on how much use the firearm has had since the last cleaning.

In some embodiments, the separators 910, 911, and 912 may facilitate the separation of cleaning implement 900 into a plurality of separate cleaning elements. In some embodiments, the separators 910, 911, and 912 may be a score mark on the shaft 908. Such embodiment may allow a user to separate sections of cleaning implement 900 by hand and without the use of a tool. In other embodiments, the separators 910, 911, and 912 may simply provide an indication of a suggested point of separation. Such embodiments may involve use of a cutting tool (e.g., scissors, a knife, etc.) to separate sections of cleaning implement 900. In some embodiments, the shaft may comprise wood, plastic, metal, or any suitable material.

Figure 10A:
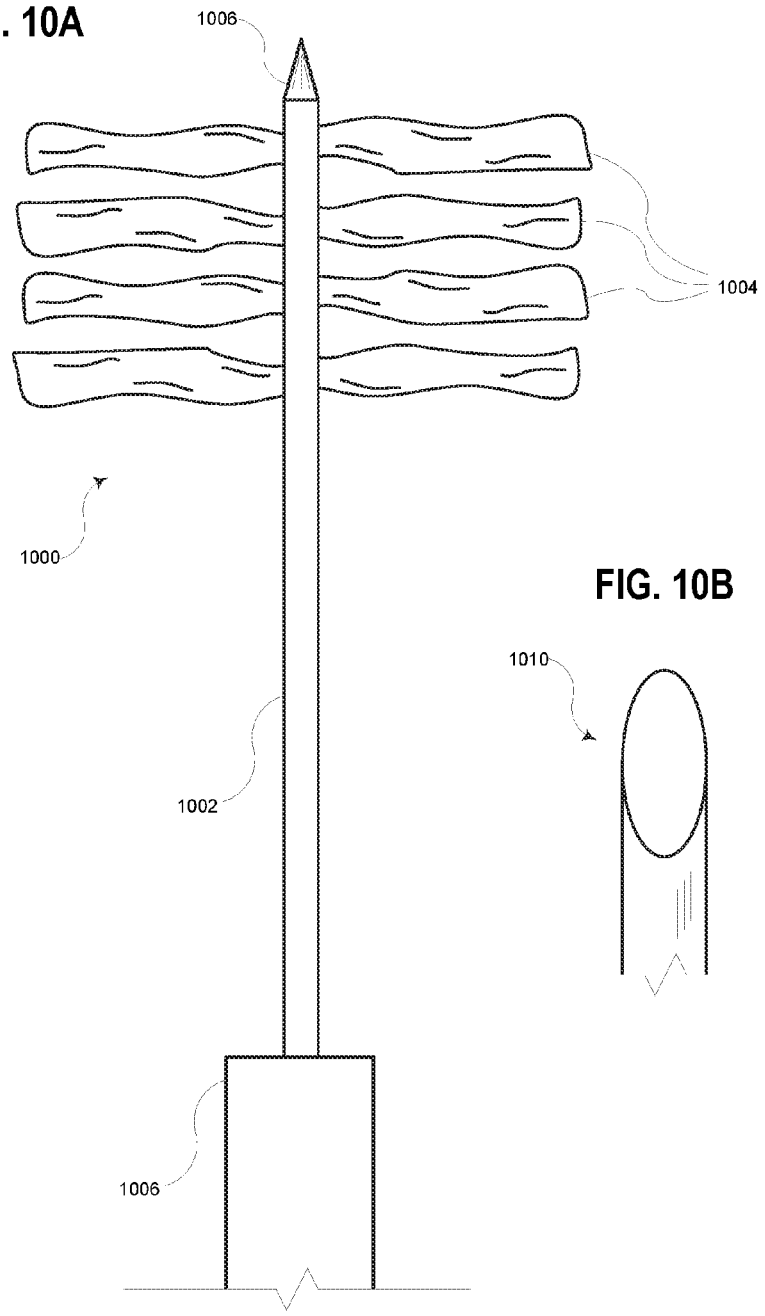
FIG. 10A illustrates a disposable cleaning implement having a plurality of cleaning surfaces and a pointed distal end consistent with embodiments of the present disclosure.

FIG. 10A illustrates a disposable cleaning implement 1000 having a plurality of cleaning surfaces 1004 and a pointed distal end consistent with embodiments of the present disclosure. Cleaning surfaces 1004 are disposed at a distal end of a shaft 1002. In some embodiments, the cleaning surfaces 1004 may comprise cotton, wool, felt, flannel, synthetic fibers, and the like. In other embodiments, a more abrasive material may be used to form the cleaning surfaces 1004, such as steel wool, brass wool, pumice mixed with cotton threads, ceramic abrasives mixed with cotton threads, other metals/metallic alloys, and the like. A more coarse or abrasive substance may be used when dictated by the condition of the barrel (i.e., amount of fouling in the barrel). The plurality of cleaning surfaces 1004 may be compressed when inserted into the barrel of a firearm. The compression of the cleaning surfaces 1004 may exert an outward pressure on the barrel of the firearm and increase the ability of the cleaning surfaces 1004 to clean the barrel.

The shaft 1002 may be received in a receptacle at the end of a cleaning rod 1006. A diameter of the shaft 1002 may be smaller than the end of the cleaning rod 1006, which according to various embodiments may be a commercially available product or a custom model, configured to receive the shaft 1002 and to push the cleaning implement 1000 along the length of a barrel of a firearm. When the cleaning surfaces 1004 are pushed out of the end of a distal end of a barrel of a firearm, the cleaning surfaces may impede re-entry of the cleaning implement 1000 into the barrel of the firearm as the rod 1006 is withdrawn from the barrel. Although cleaning surfaces 1004 are presented as extending from opposite sides of the shaft 1002, in alternative embodiments, the cleaning surfaces 1004 may be oriented at any angle. For example, in some embodiments, four sets of cleaning surfaces may be disposed about a circumference of the shaft at approximately 90° angles to one another.

In the illustrated embodiment, shaft 1002 may terminate with a sharp point 1006. The sharp point 1006 may be used in various embodiments to scrape carbon deposits, dirt, and the like from the barrel or other areas and parts of a firearm. As may be appreciated, a variety of embodiments of cleaning implements disclosed herein may include a sharp point at a distal end of the shaft for scraping the barrel of a firearm. For example, the embodiments illustrated in FIG. 1 may be modified by extending the shaft to protrude beyond the distal cleaning surface and providing a sharpened tip on the extended shaft.

Figure 10B:
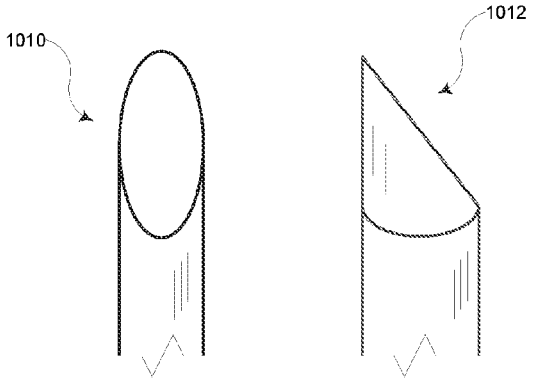
FIG. 10B illustrates alternative pointed distal ends that may be utilized in connection with cleaning implements consistent with embodiments of the present disclosure.

FIG. 10B illustrates alternative pointed distal ends 1010 and 1012 that may be utilized in connection with cleaning implements consistent with embodiments of the present disclosure. Pointed distal ends 1010 and 1012 may be formed by cutting a shaft of a cleaning implement at approximately a 45° angle. The pointed distal ends 1010 and 1012 may be used to scrape carbon deposits, dirt, and the like from the barrel or other areas and parts of a firearm. In various embodiments, different shaped pointed distal ends may be utilized in connection with various cleaning implements for scraping the barrel or other areas and parts of a firearm.

Figure 11B:
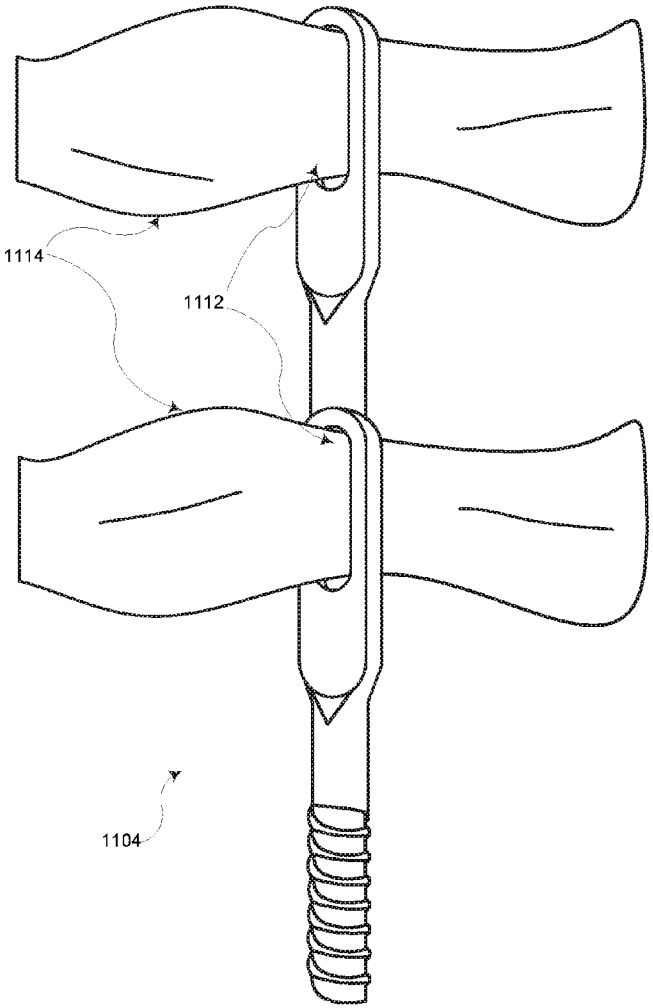
FIG. 11B illustrates cleaning implement, as illustrated in FIG. 11A, including disposable cleaning surfaces inserted into receptacles consistent with embodiments of the present disclosure.
Figure 11A:
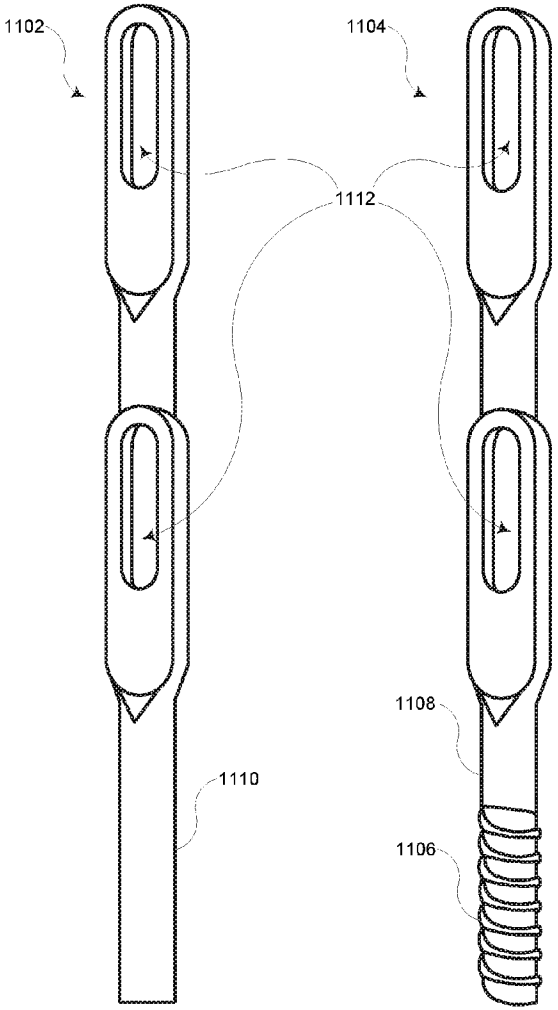
FIG. 11A illustrates reusable cleaning implements having a plurality of receptacles, each of which may be configured to receive a disposable cleaning surface consistent with embodiments of the present disclosure.

FIG. 11A illustrates reusable cleaning implements 1102, 1104 having a plurality of receptacles 1112, each of which may be configured to receive a disposable cleaning surface consistent with embodiments of the present disclosure. Reusable cleaning implement 1104 may include a threaded portion 1106 disposed at the proximal end of a shaft 1108. The threaded portion 1106 may be used in certain embodiments to couple cleaning implement 1104 to a cleaning rod (not shown) that may be used to push cleaning implement 1104 along the barrel of a firearm. Cleaning implement 1102 may rely on a friction fit connection between a shaft 1110 and a cleaning rod.

FIG. 11B illustrates cleaning implement 1104, as illustrated in FIG. 11A, including disposable cleaning surfaces 1114 inserted into receptacles 1112 consistent with embodiments of the present disclosure. In various embodiments, the cleaning surface 1114 may be embodied using a variety of materials, such as cotton, wool, felt, flannel, synthetic fibers, and the like. In other embodiments, a more abrasive material may be used to form the cleaning surfaces 1114, such as steel wool, brass wool, pumice mixed with cotton threads, ceramic abrasives mixed with cotton threads, other metals/metallic alloys, and the like. A more coarse or abrasive substance may be used when dictated by the condition of the barrel (i.e., amount of fouling in the barrel). Although FIG. 11B illustrates that the receptacles 1112 are oriented in the same direction, in various embodiments, the receptacles 1112 may be disposed at varying angles with respect to one another.

While specific embodiments and applications of the disclosure have been illustrated and described, it is to be understood that the disclosure is not limited to the precise configurations and components disclosed herein. Accordingly, many changes may be made to the details of the above-described embodiments without departing from the underlying principles of this disclosure. The scope of the present invention should, therefore, be determined only by the following claims.

What is claimed is:

1. A system to clean a barrel of a firearm, comprising:

a single-use cleaning implement comprising a hollow member;

a first cleaning surface disposed along a length of the hollow member and about a circumference of the hollow member and configured to be received within the barrel of the firearm;

a second cleaning surface disposed along the length of the hollow member and about the circumference of the hollow member and configured to be received within the barrel of the firearm;

a separator disposed between the first cleaning surface and the second cleaning surface along the length of the hollow member; and a flexible shaft configured to extend through the hollow member, the flexible shaft comprising a retainer component disposed at a distal end, the retainer component configured to abut a distal end of the single-use cleaning implement and to impede the single-use cleaning implement from passing over the retainer component;

wherein the flexible shaft is configured to permit the hollow single-use cleaning implement to be pulled through the barrel of the firearm while the retainer component abuts the distal end of the single-use cleaning implement and the first cleaning surface and the second cleaning surface engage with an inner surface of the barrel to clean the barrel.

2. The system of claim 1, wherein a diameter of the single-use cleaning implement exceeds a diameter of the barrel such that the single-use cleaning implement exerts an outward force against the inner surface of the barrel while the single-use cleaning implement is pulled through the barrel.

3. The system of claim 1, wherein a diameter of the first cleaning surface increases from a proximal end to the distal end along more than half of a length of the cleaning surface.

4. The system of claim 1, wherein the first cleaning surface comprises a material wrapped around the hollow member.

5. The system of claim 4, wherein the material comprises one of cotton, felt, flannel, wool, brass wool and steel wool.

6. The system of claim 1, wherein the first cleaning surface is configured to center the cleaning implement in the barrel of the firearm as the cleaning implement passes through the barrel.

7. The system of claim 1, wherein the flexible shaft comprises a first threaded connector and the retainer component comprises a second threaded connector configured to mate with the first threaded connector.

8. A system to clean a barrel of a firearm, comprising:

a single-use cleaning implement comprising a hollow member;

a first cleaning surface disposed along a length of the hollow member and about a circumference of the hollow member and configured to be received within the barrel of the firearm and to exert an outward force against the barrel of the firearm while the cleaning implement is disposed within the barrel;

a second cleaning surface disposed along a length of the hollow member and about the circumference of the hollow member and configured to be received within the barrel of the firearm and configured to be received within a barrel of the firearm and to exert an outward force against the barrel of a firearm while the cleaning implement is disposed within the barrel;

a separator disposed between the first cleaning surface and the second cleaning surface along the length of the hollow member; and a flexible shaft configured to extend through the hollow member, the flexible shaft comprising:

a first threaded connector, and a retainer component comprising a second threaded connector configured to mate with the first threaded connector and disposed at a distal end, the retainer component configured to abut a distal end of the single-use cleaning implement and to impede the single-use cleaning implement from passing over the retainer component;

wherein the flexible shaft is configured to permit the hollow single-use cleaning implement to be pulled through the barrel of the firearm while the retainer component abuts the distal end of the single-use cleaning implement and the first cleaning surface and the second cleaning surface engage with the inner surface of the barrel to clean the barrel.

9. The system of claim 8, wherein each of the first cleaning surface and the second cleaning surface comprises a material wrapped around the hollow member.

10. The system of claim 9, wherein the material comprises one of cotton, felt, flannel, wool, brass wool and steel wool.

11. The system of claim 8, wherein the first cleaning surface and the second cleaning surface are configured to center the cleaning implement in the barrel of the firearm as the cleaning implement passes through the barrel.

12. The system of claim 8, wherein the first cleaning surface and the second cleaning surface each increase in diameter from a proximal end to a distal end along more than half of a respective length.

13. A method of cleaning a barrel of a firearm, comprising:

providing a single-use cleaning implement comprising:

a hollow member;

a first cleaning surface disposed along a length of the hollow member and about a circumference of the hollow member and configured to be received within a barrel of a firearm;

a second cleaning surface disposed along the length of the hollow member and about the circumference of the hollow member and configured to be received within a barrel of a firearm;

a separator disposed between the first cleaning surface and the second cleaning surface along the length of the hollow member; and a flexible shaft configured to extend through the hollow member, the flexible shaft comprising a retainer component disposed at a distal end, the retainer component configured to abut a distal end of the single-use cleaning implement and to impede the single-use cleaning implement from passing over the retainer component; and pulling the single-use cleaning implement through the barrel of the firearm using the flexible shaft while the retainer component abuts the distal end of the single-use cleaning implement and the first cleaning surface and the second cleaning surface engage with an inner surface of the barrel to clean the barrel of the firearm.

14. The method of claim 13, wherein the first cleaning surface comprises one of cotton, felt, flannel, wool, brass wool and steel wool.

15. The method of claim 13, wherein a diameter of the first cleaning surface increases from a proximal end to the distal end along more than half of a length of the cleaning surface.

* * * * *